US009302885B2

(12) United States Patent
Christy et al.

(10) Patent No.: US 9,302,885 B2
(45) Date of Patent: Apr. 5, 2016

(54) BEST GROUP SELECTION IN ELEVATOR DISPATCHING SYSTEM INCORPORATING GROUP SCORE INFORMATION

(75) Inventors: Theresa Christy, West Hartford, CT (US); Wade Montague, Southington, CT (US); Jannah Stanley, Portland, CT (US); Daniel Williams, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 701 days.

(21) Appl. No.: 13/581,367

(22) PCT Filed: Feb. 26, 2010

(86) PCT No.: PCT/US2010/025486

§ 371 (c)(1), (2), (4) Date: Aug. 27, 2012

(87) PCT Pub. No.: WO2011/106010

PCT Pub. Date: Sep. 1, 2011

(65) Prior Publication Data

US 2012/0325589 A1 Dec. 27, 2012

(51) Int. Cl.
*B66B 1/18* (2006.01)
*B66B 1/24* (2006.01)

(52) U.S. Cl.
CPC ..... *B66B 1/2458* (2013.01); *B66B 1/2408* (2013.01); *B66B 2201/103* (2013.01); *B66B 2201/211* (2013.01); *B66B 2201/214* (2013.01); *B66B 2201/222* (2013.01)

(58) Field of Classification Search
CPC ..... B66B 1/06; B66B 1/2408; B66B 1/2458; B66B 2201/103; B66B 2201/214; B66B 2201/222; B66B 2201/211
USPC ..... 187/247, 380–388, 391, 393, 396
See application file for complete search history.

(56) References Cited

U.S. PATENT DOCUMENTS 4,792,019 A * 12/1988 Bittar et al. ..... 187/385
4,939,634 A * 7/1990 Schroder ..... 700/12

(Continued)

FOREIGN PATENT DOCUMENTS

CN 1214025 A 4/1999
JP H03124676 A 5/1991

(Continued)

OTHER PUBLICATIONS

Abstract_KR100498552.

(Continued)

*Primary Examiner* — Anthony Salata
(74) *Attorney, Agent, or Firm* — Cantor Colburn LLP

(57) ABSTRACT

An elevator dispatching system includes a plurality of elevator groups, each of the plurality of elevator groups including a group controller and a plurality of elevator cars, each of the plurality of elevator groups serving a respective set of floors; and a redirector configured to receive a service request including a destination floor, and, in the event more than one elevator group serves the destination floor, communicate the service request to the group controllers of the more than one elevator groups, wherein the respective group controllers of the more than one elevator groups are configured to each determine a respective group score, and communicate the respective group score to the redirector, and the redirector is further configured to determine the best group based on the respective group scores.

18 Claims, 3 Drawing Sheets

(56) References Cited

U.S. PATENT DOCUMENTS

| | | | | | |
|---|---|---|---|---|---|
| 4,989,695 | A | | 2/1991 | Kubo | |
| 5,183,981 | A | * | 2/1993 | Thangavelu | 187/383 |
| 5,306,878 | A | | 4/1994 | Kubo | |
| 5,511,634 | A | * | 4/1996 | Bahjat et al. | 187/383 |
| 5,831,226 | A | * | 11/1998 | Hattori et al. | 187/382 |
| 6,065,570 | A | * | 5/2000 | Friedli et al. | 187/387 |
| 6,237,721 | B1 | * | 5/2001 | Siikonen | 187/382 |
| 6,601,678 | B2 | * | 8/2003 | Kostka et al. | 187/383 |
| 6,991,068 | B2 | * | 1/2006 | Siikonen et al. | 187/383 |
| 7,117,980 | B2 | * | 10/2006 | Wyss | B66B 1/18 187/247 |
| 7,128,190 | B2 | * | 10/2006 | Kostka et al. | 187/383 |
| 7,328,775 | B2 | * | 2/2008 | Zaharia et al. | 187/396 |
| 7,416,057 | B2 | * | 8/2008 | Kostka | 187/382 |
| 7,490,698 | B2 | * | 2/2009 | Sirag, Jr. | 187/381 |
| 8,205,722 | B2 | * | 6/2012 | Suihkonen et al. | 187/383 |
| 8,387,757 | B2 | * | 3/2013 | Christy et al. | 187/387 |
| 2007/0017753 | A1 | | 1/2007 | Ylinen et al. | |
| 2013/0168190 | A1 | * | 7/2013 | Christy | B66B 1/2408 187/247 |

FOREIGN PATENT DOCUMENTS

| | | | |
|---|---|---|---|
| JP | H05246633 | A | 9/1993 |
| JP | H06321445 | A | 11/1994 |
| JP | 2000302343 | A | 10/2000 |
| JP | 2005015228 | A | 1/2005 |
| JP | 2009263037 | A | 11/2009 |
| KR | 19970074618 | A | 12/1997 |
| KR | 10-0498552 | B1 | 2/2006 |
| KR | 10-2006-0127914 | A | 12/2006 |
| KR | 20060127914 | A | 12/2006 |
| KR | 10-0821807 | B1 | 4/2008 |
| WO | WO2009068725 | A1 | 6/2009 |
| WO | WO2009070143 | A1 | 6/2009 |
| WO | 2011/106010 | A1 | 9/2011 |

OTHER PUBLICATIONS

EP1829808A1_English Equivalent to KR100821807B1.

International Search Report and Written Opinion for International Application No. PCT/US2010/025486; International Filing Date Feb. 26, 2010 mailed on Nov. 19, 2010; 5 pages.

US7281610B2_English Equivalent to KR1020060127914A.

JP Office Action for Patent Application No. 2012-554972; dated Dec. 20, 2013; 2 pages.

Chinese Office Action Translation dated Dec. 26, 2013; 4 pages.

Patent Abstract of Japan; Publication No. 64-064981; Date of Publication No. Mar. 10, 1989, "Method for Controlling Elevator", 1 page.

Chinese Search Report dated Dec. 26, 2013; Application No. 201080064725.7; filed Feb. 26, 2010; 2 pages.

Notice of Final Rejection dated Apr. 15, 2014 for Korean Application No. 10-2012-1024603 provided by Yoon and Yang IP Law Practice Group; 3 pages.

Korean Office action (translation) for application 10-2014-7024866 received Oct. 30, 2015, 5 pages.

Korean Office Action for application 10-2014-7024866 received May 8, 2015, 5 pages.

* cited by examiner

BEST GROUP SELECTION IN ELEVATOR DISPATCHING SYSTEM INCORPORATING GROUP SCORE INFORMATION

CROSS REFERENCE TO RELATED APPLICATION

This is a U.S. national stage of application No. PCT/US2010/025486, filed on 26 Feb. 2010. Priority under 35 U.S.C. §119(a) and 35 U.S.C. §365(b) is claimed, and all the benefits accruing therefrom under 35 U.S.C. §119, the contents of which in its entirety are herein incorporated by reference.

FIELD OF INVENTION

The subject matter disclosed herein pertains generally to the field of elevator dispatching systems

DESCRIPTION OF RELATED ART

An elevator system may comprise a plurality of elevator groups, each group servicing a set of floors. In such a system, a passenger may select an elevator group from which to request service based on his or her destination. Some destination floors may be serviced by more than one elevator group. If more than one elevator group serves the destination, the passenger may select an elevator group based on factors such as physical location of the elevator group or lobby crowding. After the passenger has selected an elevator group, he or she may enter a service request. Upon receipt of the service request, a group controller associated with the selected group may evaluate each car in the selected group to determine which car in the group should be assigned to service the passenger. The best car for servicing the request may be selected by the group controller using a set of defined criteria, and the selected best car may be assigned to service the request. However, the group controller may only choose among cars in its particular elevator group. Because the elevator group has already been selected by the passenger, and group information is the same for each car in a group, group information is not a factor when choosing the best car.

BRIEF SUMMARY

According to one aspect of the invention, an elevator dispatching system includes a plurality of elevator groups, each of the plurality of elevator groups comprising a group controller and a plurality of elevator cars, each of the plurality of elevator groups serving a respective set of floors; and a redirector configured to receive a service request comprising a destination floor, and, in the event more than one elevator group serves the destination floor, communicate the service request to the group controllers of the more than one elevator groups, wherein the respective group controllers of the more than one elevator groups are configured to each determine a respective group score, and communicate the respective group score to the redirector and the redirector is further configured to determine the best group based on the respective group scores.

According to one aspect of the invention, a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, the method including receiving a service request comprising a destination floor by a redirector; in the event more than one elevator group serves the destination floor, determining a respective group score for each of the more than one elevator groups by the respective group controllers of the more than one elevator groups and communicating the respective group scores to the redirector; and determining a best group of the plurality of elevator groups by the redirector based on the respective group scores.

According to one aspect of the invention, a computer program product comprising a computer readable storage medium containing computer code that, when executed by a computer, implements a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, wherein the method includes receiving a service request comprising a destination floor; in the event more than one elevator group serves the destination floor, receiving a respective group score for each of the more than one elevator groups from the respective group controllers of the more than one elevator groups; and determining a best group of the plurality of elevator groups based on the respective group scores.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

Embodiments of systems and methods for best group selection in an elevator dispatching system are provided, with exemplary embodiments being discussed below in detail. An elevator dispatching system may comprise one or more global destination entry devices, allowing a passenger to enter a service request without first selecting a specific elevator group in a multi-group elevator system. The elevator dispatching system may then select the best group to service the request. In order to balance traffic between elevator groups, and avoid sending passengers to a crowded elevator group if there exists a less crowded elevator group capable of servicing the request, group information for each elevator group capable of servicing the request may be evaluated to determine the best group. The best group may be selected based on determination of a group score for each group that is capable of servicing the request. The group scores may be determined by each group's respective group controller based previously established criteria that allow comparison of groups. The group score is the same for each car in a single group, and thus may not be used to differentiate between cars in a group. Once the best group is selected, a best car may be selected from the best group.

Directing traffic to a less crowded elevator group when more than one elevator group is capable of fulfilling a service request may reduce crowding and balance traffic among multiple elevator groups. Passengers may experience less crowded lobby and car conditions, and building owners may enjoy reduced lobby queuing, as lobby queuing is a visible problem that is an informal measure of an elevator system's perceived performance.

Figure 1:
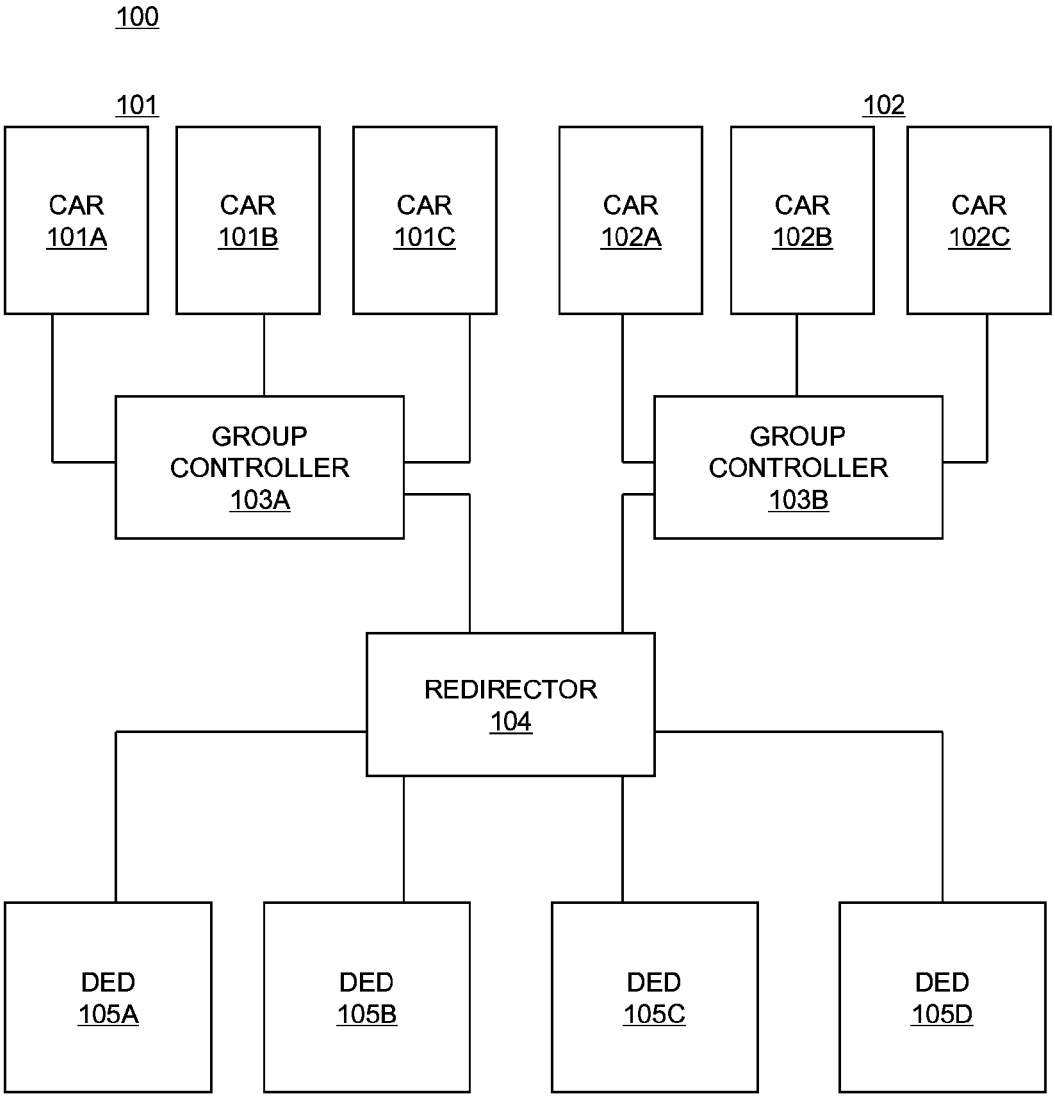
FIG. 1 illustrates an embodiment of an elevator dispatching system.

An embodiment of an elevator dispatching system 100 is shown in FIG. 1. Cars 101*a-c* comprise a first elevator group 101, and are controlled by controller 103*a*. Cars 102*a-c* comprise a second elevator group 102, and are controlled by controller 103*b*. Controllers 103*a-b* are connected to redirector 104. Controllers 103*a-b* may be located in any appropriate physical location in elevator dispatching system 100, such as in one of the individual cars of a controller's respective group. A group may comprise one or more backup group controllers, however, each group may have only one active group controller at any given time. Passengers may input service requests into one of destination entry devices (DEDs) 105*a-d* by entering a floor value for their destination. The service requests are processed by the redirector 104 to determine a best elevator group to service the request based on group scores received from group controllers 103*a-b*. After the best group is determined, a best car within the best group is determined. One of DEDs 105*a-d* indicates the selected best group and best car to the passenger. Elevator groups 101 and 102, cars 101*a-c* and 102*a-c*, controllers 103*a-b*, and DEDs 105*a-d* are shown for illustrative purposes only; an elevator dispatching system may comprise any appropriate number of elevator groups, cars, controllers, and DEDs. An elevator group, such as elevator groups 101 and 102, may service any subset of floors in a building, and one or more floors of the system may be serviced by more than one elevator group. Group selection may be performed by a group selection module located in redirector 104 based on group scores received from group controllers 103*a-b*.

Figure 2:
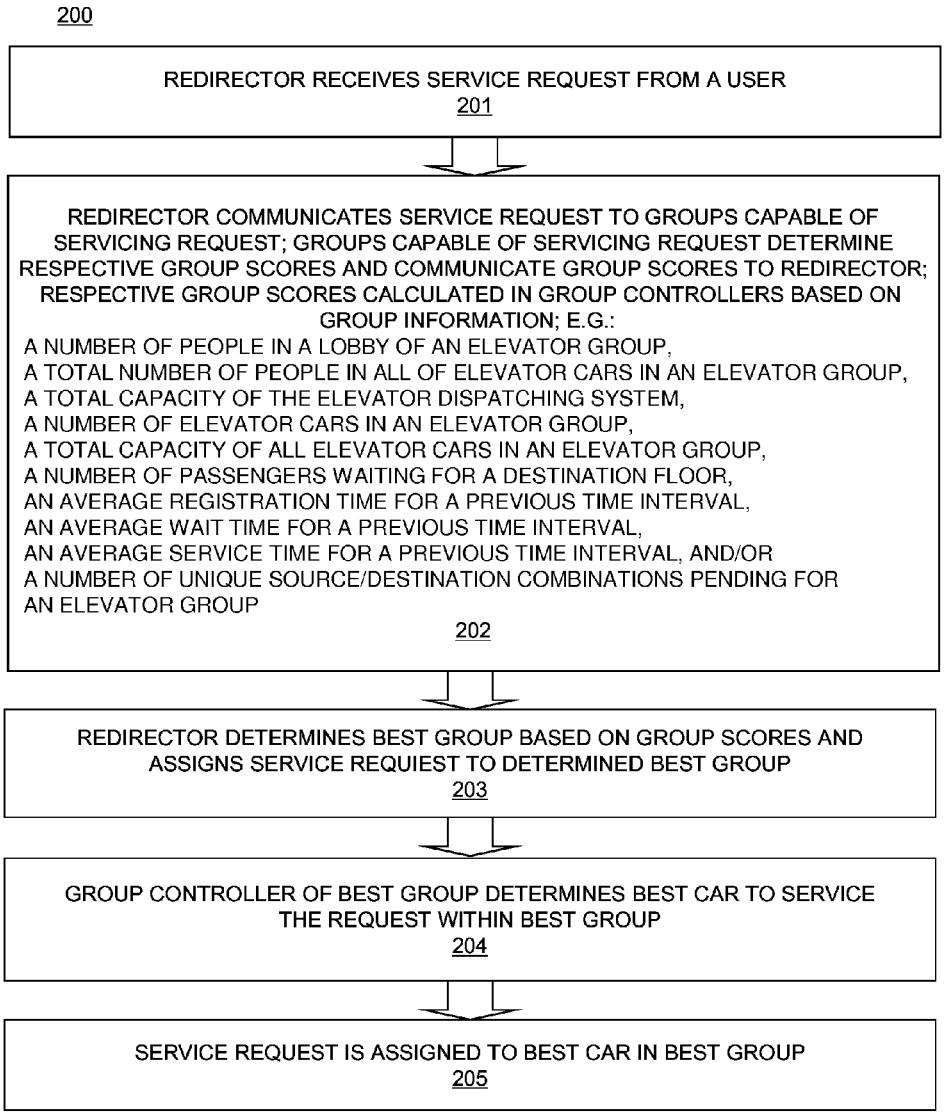
FIG. 2 illustrates an embodiment of a method for best group selection in an elevator dispatching system incorporating group score information.

FIG. 2 illustrates an embodiment of a method for best group selection that may be embodied in a group selection module in a redirector. FIG. 2 is discussed with reference to FIG. 1. In block 201, redirector 104 receives a service request comprising a destination floor from one of DEDs 105*a-d*. In block 202, the redirector 104 communicates the service request to each elevator group capable of servicing the request, and receives a group score from each group controller of a group capable of servicing the request. A group score may be calculated by a group's group controller 103*a-b* using any available group information, including but not limited to a number of people currently in an elevator group's lobby, the total number of people in all of the elevator cars in a group, a total capacity of the elevator system, the number of cars in one group, the total capacity of all the cars in one group, a number of passengers waiting for a specific subset of floor destinations (where the subset varies depending on previously observed traffic patterns or the time of day), average registration, wait time, and or service time for a previous time interval, average registration, wait time, and or service time for a previous time interval for a specific set of destination floors, or a number of unique source/destination combinations pending for each group. Any of the above information may be used by group controllers 103*a-b* to determine a group score.

The data used to determine the best group may be configurable by a system administrator. For example, it may be configurable whether to use time of day for selecting the best group. If time of day is used, then the specific time periods may also be configurable. The information used by the redirector 104 to select a best group for a new service request may be combined in various ways including weighted parameters, fuzzy logic, weighted averages or any other evaluation of the available information.

In block 203, the redirector determines a best group to service the request based on the received group scores and assigns the service request to the determined best group. In some embodiments, the group having the highest group score may be selected as the best group, in other embodiments, the group having the lowest group score may be selected as the best group. The redirector 104 may also consider override conditions, which may cause one group to be chosen over another even if their respective group scores indicate a different choice. Override conditions may include: a specific elevator group may already have a waiting passenger going from the same origin and to the same destination as the service request, or a specific group may already have a waiting passenger going from the same origin as the service request. The distance from the DED at which the service request was entered to the furthest car in each group may also be considered; passengers with disabilities may cause the redirector to allocate their service request to the closest group capable of servicing the request as measured by the distance from the particular DED at which the service request was entered.

Returning to FIG. 2, in block 204, a best car from the determined best group is determined by the group controller of the determined best group. In block 205, the passenger is assigned to the determined best group and best car; the assignment may be indicated to the passenger via one of DEDs 105*a-d*.

Application of method 200 is illustrated in the following example, in which the group score is an average of the number of people currently in a group's elevator lobby and the total number of people in all of the elevator cars in the group. Referring to FIG. 1, group 101 is a 3 car (101*a-c*) low-rise group serving the lobby and floors 1-10. Group 102 is a 3 car (102*a*0*c*) high-rise group serving the lobby, floor 5, and floors 10-18. Floor 5 is a cafeteria floor; during certain times of the day a large proportion of traffic is going to this floor. The goal is to balance traffic between groups 101 and 102.

In this example, group 101 has 12 people in the lobby: 8 waiting for car 101*a* and 4 waiting for car 101*b*. There are also 16 people currently in the cars 101*a-c:* 4 people in car 101*a,* 5 people in car 101*b*, and 7 people in car 101*c*. Group 102 has 22 people waiting in the lobby: 7 waiting for car 102*a,* 7 waiting for car 102*b*, and 8 waiting for car 102*c*. There are also 5 people currently in the group 102 cars 102*a-c:* 2 in car 102*a*, and 3 in car 102*b*. In this example, the group controllers 103*a-b* determine group scores for their respective group, and communicate the determined group scores to redirector 104 in order to allow redirector 104 to determine a best group to service the request based on the group scores. In this example, the group score for a group is the average of the number of people currently in the group's elevator lobby and the total number of people in all of the elevator cars in the group; therefore, the group score for group 101 is 14, and the group score for group 102 is 13.5. The group score is better for group 102 than for group 101; therefore, the redirector 104 assigns the service request is assigned to group 102. Group controller 103*b* of group 102 then selects the best car from among cars 102*a-c;* the selection may be based on the estimated wait time for the various cars in group 102. The individual cars in the elevator system 100 are not evaluated until after the best group is selected.

Figure 3:
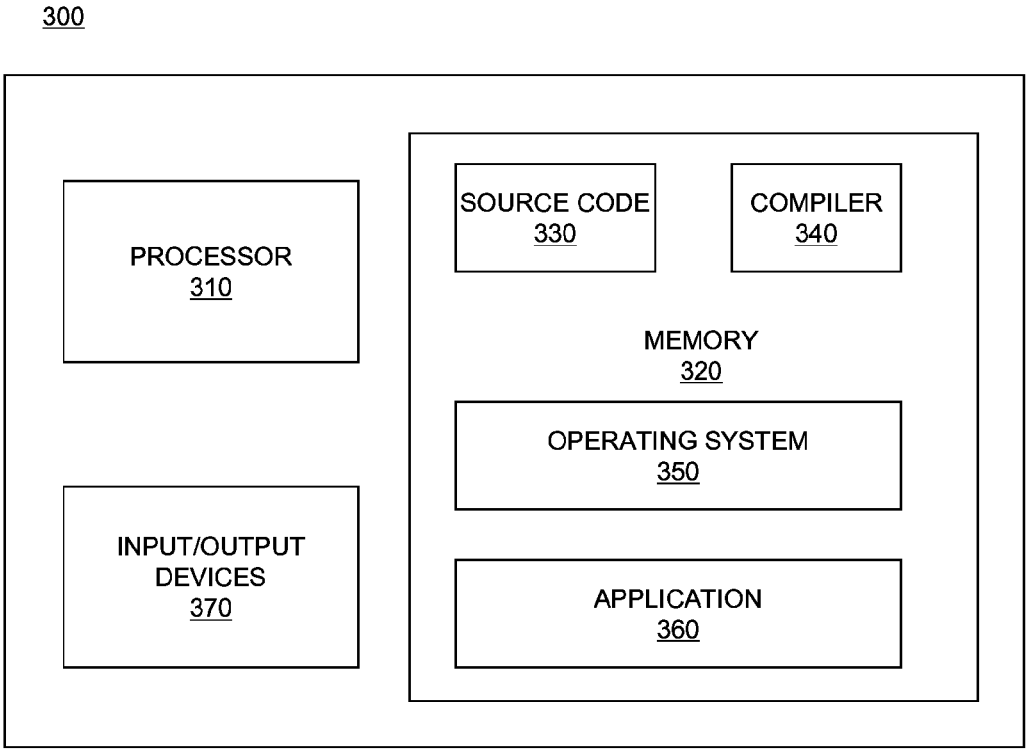
FIG. 3 illustrates an embodiment of a computer that may be used in conjunction with embodiments systems and methods for best group selection in an elevator dispatching system incorporating group score information.

FIG. 3 illustrates an example of a computer 300 which may be utilized by exemplary embodiments of systems and methods for best group selection using group score information in an elevator dispatching system as embodied in software. Various operations discussed above may utilize the capabilities of the computer 300. One or more of the capabilities of the computer 300 may be incorporated in any element, module, application, and/or component discussed herein.

The computer 300 includes, but is not limited to, PCs, workstations, laptops, PDAs, palm devices, servers, storages, and the like. Generally, in terms of hardware architecture, the computer 300 may include one or more processors 310, memory 320, and one or more input and/or output (I/O) devices 370 that are communicatively coupled via a local interface (not shown). The local interface can be, for example but not limited to, one or more buses or other wired or wireless connections, as is known in the art. The local interface may have additional elements, such as controllers, buffers (caches), drivers, repeaters, and receivers, to enable communications. Further, the local interface may include address, control, and/or data connections to enable appropriate communications among the aforementioned components.

The processor 310 is a hardware device for executing software that can be stored in the memory 320. The processor 310 can be virtually any custom made or commercially available processor, a central processing unit (CPU), a digital signal processor (DSP), or an auxiliary processor among several processors associated with the computer 300, and the processor 310 may be a semiconductor based microprocessor (in the form of a microchip) or a macroprocessor.

The memory 320 can include any one or combination of volatile memory elements (e.g., random access memory (RAM), such as dynamic random access memory (DRAM), static random access memory (SRAM), etc.) and nonvolatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory 320 may incorporate electronic, magnetic, optical, and/or other types of storage media. Note that the memory 320 can have a distributed architecture, where various components are situated remote from one another, but can be accessed by the processor 310.

The software in the memory 320 may include one or more separate programs, each of which comprises an ordered listing of executable instructions for implementing logical functions. The software in the memory 320 may include a suitable operating system (O/S) 350, compiler 340, source code 330, and one or more applications 360 in accordance with exemplary embodiments. As illustrated, the application 360 comprises numerous functional components for implementing the features and operations of the exemplary embodiments. The application 360 of the computer 300 may represent various applications, computational units, logic, functional units, processes, operations, virtual entities, and/or modules in accordance with exemplary embodiments, but the application 360 is not meant to be a limitation.

The operating system 350 controls the execution of other computer programs, and provides scheduling, input-output control, file and data management, memory management, and communication control and related services. It is contemplated by the inventors that the application 360 for implementing exemplary embodiments may be applicable on all commercially available operating systems.

Application 360 may be a source program, executable program (object code), script, or any other entity comprising a set of instructions to be performed. When a source program, then the program is usually translated via a compiler (such as the compiler 340), assembler, interpreter, or the like, which may or may not be included within the memory 320, so as to operate properly in connection with the O/S 350. Furthermore, the application 360 can be written as an object oriented programming language, which has classes of data and methods, or a procedure programming language, which has routines, subroutines, and/or functions, for example but not limited to, C, C++, C#, Pascal, BASIC, API calls, HTML, XHTML, XML, ASP scripts, FORTRAN, COBOL, Perl, Java, ADA, .NET, and the like.

The I/O devices 370 may include input devices such as, for example but not limited to, a mouse, keyboard, scanner, microphone, camera, etc. Furthermore, the I/O devices 370 may also include output devices, for example but not limited to a printer, display, etc. Finally, the I/O devices 370 may further include devices that communicate both inputs and outputs, for instance but not limited to, a NIC or modulator/demodulator (for accessing remote devices, other files, devices, systems, or a network), a radio frequency (RF) or other transceiver, a telephonic interface, a bridge, a router, etc. The I/O devices 370 also include components for communicating over various networks, such as the Internet or intranet.

If the computer 300 is a PC, workstation, intelligent device or the like, the software in the memory 320 may further include a basic input output system (BIOS) (omitted for simplicity). The BIOS is a set of essential software routines that initialize and test hardware at startup, start the O/S 350, and support the transfer of data among the hardware devices. The BIOS is stored in some type of read-only-memory, such as ROM, PROM, EPROM, EEPROM or the like, so that the BIOS can be executed when the computer 300 is activated.

When the computer 300 is in operation, the processor 310 is configured to execute software stored within the memory 320, to communicate data to and from the memory 320, and to generally control operations of the computer 300 pursuant to the software. The application 360 and the O/S 350 are read, in whole or in part, by the processor 310, perhaps buffered within the processor 310, and then executed.

When the application 360 is implemented in software it should be noted that the application 360 can be stored on virtually any computer readable medium for use by or in connection with any computer related system or method. In the context of this document, a computer readable medium may be an electronic, magnetic, optical, or other physical device or means that can contain or store a computer program for use by or in connection with a computer related system or method.

The application 360 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

More specific examples (a nonexhaustive list) of the computer-readable medium may include the following: an electrical connection (electronic) having one or more wires, a portable computer diskette (magnetic or optical), a random access memory (RAM) (electronic), a read-only memory (ROM) (electronic), an erasable programmable read-only memory (EPROM, EEPROM, or Flash memory) (electronic), an optical fiber (optical), and a portable compact disc memory (CDROM, CD R/W) (optical). Note that the computer-readable medium could even be paper or another suitable medium, upon which the program is printed or punched, as the program can be electronically captured, via for instance optical scanning of the paper or other medium, then compiled, interpreted or otherwise processed in a suitable manner if necessary, and then stored in a computer memory.

In exemplary embodiments, where the application 360 is implemented in hardware, the application 360 can be implemented with any one or a combination of the following technologies, which are well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The technical effects and benefits of exemplary embodiments include reduction of elevator car crowding and lobby queuing.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator dispatching system, comprising:

a plurality of elevator groups, each of the plurality of elevator groups comprising a respective group controller and a respective plurality of elevator cars, each of the plurality of elevator groups serving a respective set of floors; and a redirector that is in communication with the respective group controller of each of the plurality of elevator groups, the redirector configured to:

receive a service request comprising a destination floor;

determine whether more than one elevator group of the plurality of elevator groups serves the destination floor; and based on determining that more than one elevator group of the plurality of elevator groups serves the destination floor:

communicate the service request to the respective group controller of each of the more than one elevator groups;

receive, from the respective group controller of each of the more than one elevator groups, a respective group score that was calculated based on the service request;

determine a best group of the one or more elevator groups for the service request based on the received respective group scores; and assign the service request to the determined best group, wherein the respective group controller of the best group determines a best car for the service request from the respective plurality of elevator cars of the determined best group.

2. The elevator dispatching system of claim 1, wherein the determined best car is communicated from the respective group controller of the best group to the redirector; and further comprising at least one destination entry device, the at least one destination entry device configured to:

receive the service request from a user;

send the service request to the redirector;

receive the determined best group and best car from the redirector; and display the determined best group and best car to the user.

3. The elevator dispatching system of claim 1, wherein the respective group score is calculated in the respective group controller of each of the more than one elevator groups based on: a number of people in a lobby of an elevator group.

4. The elevator dispatching system of claim 1, wherein the respective group score is calculated in the respective group controller of each of the more than one elevator groups based on a total number of people in all of elevator cars in an elevator group.

5. The elevator dispatching system of claim 1, wherein the respective group score is calculated in the respective group controller of each of the more than one elevator groups based on a total capacity of the elevator dispatching system.

6. The elevator dispatching system of claim 1, wherein the respective group score is calculated in the respective group controller of each of the more than one elevator groups based on a number of elevator cars in an elevator group.

7. The elevator dispatching system of claim 1, wherein the respective group score is calculated in the respective group controller of each of the more than one elevator groups based on a total capacity of all elevator cars in an elevator group.

8. The elevator dispatching system of claim 1, wherein the respective group score is calculated in the respective group controller of each of the more than one elevator groups based on a number of passengers waiting for a destination floor.

9. The elevator dispatching system of claim 1, wherein the respective group score is calculated in the respective group controller of each of the more than one elevator groups based on an average registration time for a previous time interval.

10. The elevator dispatching system of claim 1, wherein the respective group score is calculated in the respective group controller of each of the more than one elevator groups based on an average wait time for a previous time interval.

11. The elevator dispatching system of claim 1, wherein the respective group score is calculated in the respective group controller of each of the more than one elevator groups based an average service time for a previous time interval.

12. The elevator dispatching system of claim 1, wherein the respective group score is calculated in the respective group controller of each of the more than one elevator groups based on a number of unique source/destination combinations pending for an elevator group.

13. A method for best group selection in an elevator dispatching system, the elevator dispatching system comprising a plurality of elevator groups, each of the plurality of elevator groups comprising a respective group controller and a respective plurality of elevator cars, each of the plurality of elevator groups serving a respective set of floors, the method comprising:

receiving a service request comprising a destination floor by a redirector that is in communication with the respective group controller of each of the plurality of elevator groups;

determining whether more than one elevator group of the plurality of elevator groups serves the destination floor; and based on determining that more than one elevator group of the plurality of elevator groups serves the destination floor:

communicating the service request to the respective group controller of each of the more than one elevator groups;

receiving, from the respective group controller of each of the more than one elevator groups, a respective group score that was calculated based on the service request;

determining a best group of the one or more elevator groups by the redirector based on the received respective group scores; and assigning the service request to the determined best group, wherein the respective group controller of the best group determines a best car for the service request from the respective plurality of elevator cars of the determined best group.

14. The method of claim 13, wherein the determined best car is communicated from the respective group controller of the best group to the redirector; and further comprising:

receiving the service request from a user at a destination entry device and sending the service request from the destination entry device to the redirector; and receiving the determined best group and best car by the destination entry device from the redirector, and displaying the determined best group and best car to the user by the destination entry device.

15. The method of claim 13, wherein the respective group scores are determined based on at least one of: a number of people in a lobby of an elevator group, a total number of people in all of elevator cars in an elevator group, a total capacity of the elevator dispatching system, a number of elevator cars in an elevator group, a total capacity of all elevator cars in an elevator group, a number of passengers waiting for a destination floor, an average registration time for a previous time interval, an average wait time for a previous time interval, an average service time for a previous time interval, or a number of unique source/destination combinations pending for an elevator group.

16. A computer program product comprising a non-transitory computer readable storage medium containing computer code that, when executed by a computer, implements a method for best group selection in an elevator dispatching system, the elevator dispatching system comprising a plurality of elevator groups, each of the plurality of elevator groups comprising a respective group controller and a respective plurality of elevator cars, each of the plurality of elevator groups serving a respective set of floors, wherein the method comprises:

receiving a service request comprising a destination floor by a redirector that is in communication with the respective group controller of each of the plurality of elevator groups;

determining whether more than one elevator group of the plurality of elevator groups serves the destination floor; and based on determining that more than one elevator group of the plurality of elevator groups serves the destination floor:

communicating the service request to the respective group controller of each of the more than one elevator groups;

receiving, from the respective group controller of each of the more than one elevator groups, a respective group score that was calculated based on the service request;

determining a best group of the one or more elevator groups by the redirector based on the received respective group scores; and assigning the service request to the determined best group, wherein the respective group controller of the best group determines a best car for the service.

17. The computer program product according to claim 16, wherein the determined best car is communicated from the respective group controller of the best group to the redirector; and further comprising:

receiving a service request from a user at a destination entry device and sending the service request from the destination entry device to the redirector; and request from the respective plurality of elevator cars of the determined best group.

receiving the determined best group and best car by the destination entry device from the redirector, and displaying the determined best group and best car to the user by the destination entry device.

18. The computer program product according to claim 16, wherein the respective group scores are determined based on at least one of: a number of people in a lobby of an elevator group, a total number of people in all of elevator cars in an elevator group, a total capacity of the elevator dispatching system, a number of elevator cars in an elevator group, a total capacity of all elevator cars in an elevator group, a number of passengers waiting for a destination floor, an average registration time for a previous time interval, an average wait time for a previous time interval, an average service time for a previous time interval, or a number of unique source/destination combinations pending for an elevator group.

* * * * *